166-274 SR
8/17/82 XR 4,344,486

United States Patent [19] [11] 4,344,486
Parrish [45] Aug. 17, 1982

[54] METHOD FOR ENHANCED OIL RECOVERY

[75] Inventor: David R. Parrish, Tulsa, Okla.

[73] Assignee: Standard Oil Company (Indiana), Chicago, Ill.

[21] Appl. No.: 238,874

[22] Filed: Feb. 27, 1981

[51] Int. Cl.[3] ..... E21B 43/24; E21B 43/40

[52] U.S. Cl. ..... 166/272; 166/266; 166/274

[58] Field of Search ..... 166/256, 265, 266, 267, 166/268, 272, 274, 302, 303; 299/2

[56] References Cited

U.S. PATENT DOCUMENTS

| | | | |
|---|---|---|---|
| 2,623,596 | 12/1952 | Whorton et al. | 166/266 X |
| 3,065,790 | 11/1962 | Holm | 166/274 |
| 3,075,918 | 1/1963 | Holm | 166/268 X |
| 3,150,716 | 9/1964 | Strelzoff et al. | 166/266 X |
| 3,193,006 | 7/1965 | Lewis | 166/266 |
| 3,228,467 | 1/1966 | Schlinger et al. | 166/266 |
| 3,480,082 | 11/1969 | Gilliland | 166/266 |
| 3,780,805 | 12/1973 | Green | 166/267 X |
| 4,005,752 | 2/1977 | Cha | 299/2 |
| 4,114,688 | 9/1978 | Terry | 166/266 X |
| 4,130,403 | 12/1978 | Cooley et al. | 55/16 |

*Primary Examiner*—Stephen J. Novosad
*Assistant Examiner*—George A. Suchfield
*Attorney, Agent, or Firm*—Scott H. Brown; Fred E. Hook

[57] ABSTRACT

Disclosed is a method and apparatus for the enhanced recovery of liquid hydrocarbons from underground formations, said method comprising recovering a mixture comprising carbon dioxide and contaminants comprising hydrocarbon, hydrogen sulfide, or mixtures thereof, from an underground formation; combusting said mixture with an oxygen enriched gas to form a concentrated carbon dioxide stream; and injecting at least a portion of said concentrated carbon dioxide stream into an underground formation to enhance recovery of liquid hydrocarbon.

12 Claims, 1 Drawing Figure

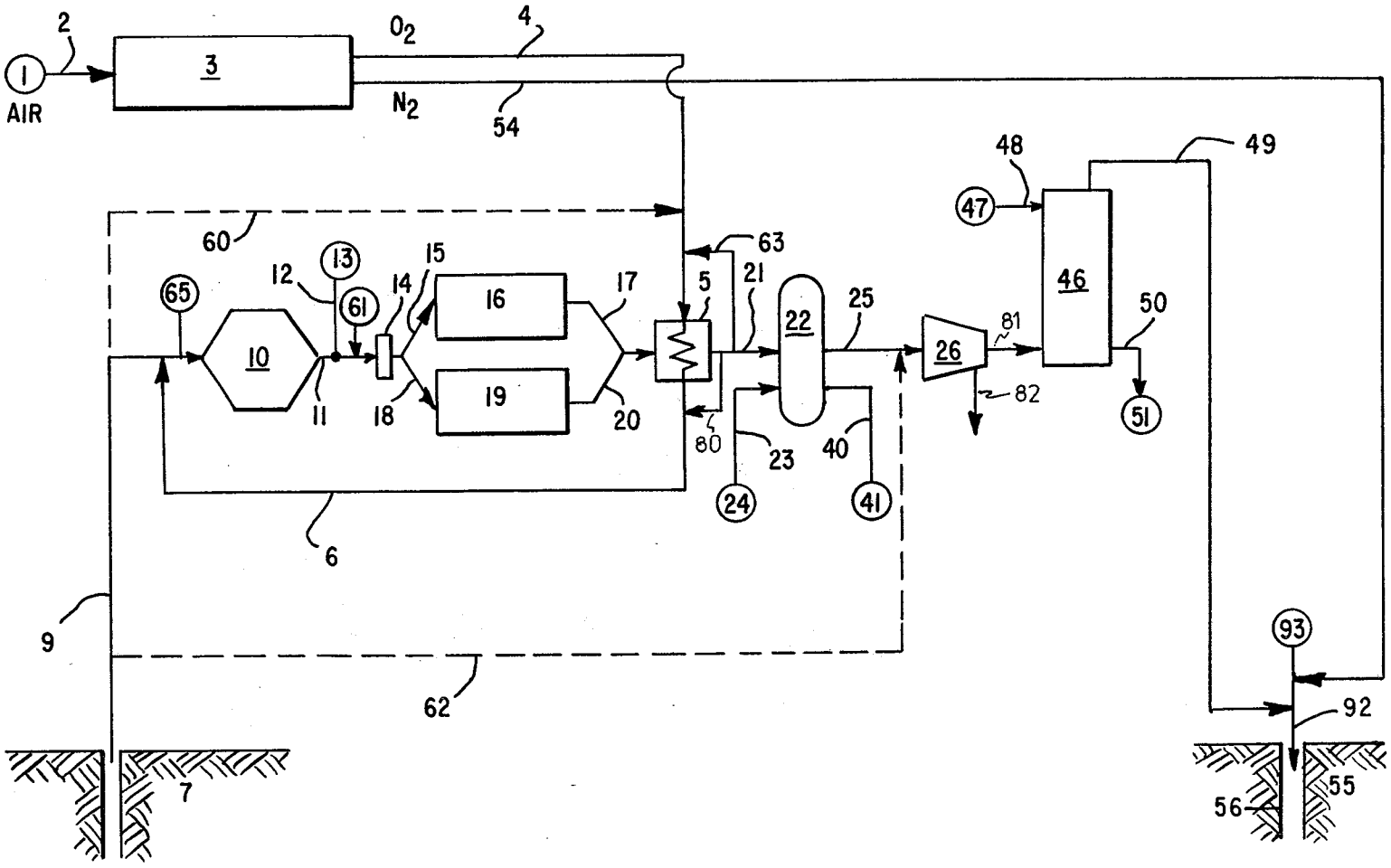
AIR
1
2
3
4
54
$O_2$
$N_2$
5
6
7
9
10
11
12
13
61
14
15
16
17
18
19
20
21
22
23
24
25
26
40
41
46
47
48
49
50
51
60
62
63
65
80
81
82
92
93
55
56

METHOD FOR ENHANCED OIL RECOVERY

BACKGROUND

This application is directed to a method and apparatus for the enhanced recovery of liquid hydrocarbons from underground formations. When the rate of hydrocarbon production from an underground formation becomes unacceptably low, various techniques can be used to enhance oil recovery. One method of enhanced oil revovery uses a stream comprising carbon dioxide. The effectiveness of the carbon dioxide as an aid to oil recovery is dependent on its miscibility with the underground oil. By passing carbon dixoide into an underground oil formation at a reservoir pressure above approximately 1,000 psia and a temperature of about 100°-150° F., the carbon dioxide becomes partially miscible with the oil and helps move it toward a well where the hydrocarbon can be produced. The miscibility of the carbon dioxide is dependent upon carbon dioxide purity, oil type, and reservoir pressure and temperature. Contaminants such as nitrogen, oxygen, oxides of nitrogen, carbon monoxide and methane generally are detrimental to such oil miscibility. Therefore, it is desirable that carbon dioxide streams used in enhanced oil recovery be substantially free from such contaminants.

There is abundant literature teaching the various methods of advanced enhanced oil recovery, including those using carbon dioxide. See *Carbon Dioxide for the Recovery of Crude Oil,* T. Doscher, University of Southern California, DOE Contract ET-78-C-05-5785.

Carbon dioxide can be found naturally occurring in underground formations, often in conjunction with methane and other light hydrocarbons and hydrogen sulfide. In order for such carbon dioxide to be useful in enhanced oil recovery, it is often necessary to purify the carbon dioxide stream, often by absorption, cryogneic separation, or membrane separation techniques such as described in Cooley et al., U.S. Pat. No. 4,130,403. In most cases, naturally occurring carbon dioxide reservoirs are not located near the oil field to be treated, and carbon dioxide pipeline transportation costs can be substantial.

Carbon dioxide can be recovered from crude oil reservoirs which are being subjected to carbon dioxide injection. Depending on well location, time from initial gas injection, and other factors varying amounts of carbon dioxide are recovered along with hydrocarbons from production wells.

Carbon dioxide can also be generated by the combustion of carbonaceous materials such as hydrocarbon as is taught by Holm, U.S. Pat. No. 3,075,918. Holm teaches that the hydrocarbon can be burned in air the combustion products compressed and carbon dioxide selectively absorbed from the combustion products so that a suitably pure carbon dioxide stream is recovered for enhanced oil recovery. Such purification process can be extremely expensive.

Holm, U.S. Pat. No. 3,065,790 teaches the manufacture of carbon dioxide for enhanced oil recovery by the combustion of hydrocarbons. Natural gas or crude oil is burned in air or oxygen. When air is used, a purifying step may be required to remove nitrogen. Holm teaches that noncondensable constituents such as nitrogen do not have a deleterious effect in enhanced oil recovery if they are present in small amounts (less than 5 percent), however they can be tolerated in amounts up to about 20 percent.

It is an object of this invention to provide a method and apparatus for the enhanced recovery of oil.

It is an object of this invention to provide sources of purified carbon dioxide for enhanced oil recovery from underground carbon dioxide which is contaminated with methane, light hydrocarbons, hydrogen sulfide, or mixtures thereof.

It is further an object of this invention to provide a method and apparatus for the manufacture of concentrated carbon dioxide streams which does not require expensive separation of undesirable contaminants such as nitrogen.

SUMMARY OF THE INVENTION

The objects of this invention can be attained by a method and apparatus for the manufacture of a purified carbon dioxide stream from carbon dioxide streams from underground formations. The purified carbon dioxide stream can then be used for the enhanced recovery of liquid hydrocarbon from underground formations.

The method comprises recovering a mixture comprising carbon dioxide and contaminants comprising hydrocarbon, hydrogen sulfide, or mixtures thereof, from an underground formation; combusting said mixture with an oxygen enriched gas to form a concentrated carbon dioxide stream; and injecting at least a portion of said concentrated carbon dioxide stream into an underground formation to enhance recovery of liquid hydrocarbon. The combustion oxidizes a substantial portion of the contaminants to other chemical forms. Contaminant hydrocarbon is substantially oxidized to carbon dioxide and water, thereby reducing the amount of hydrocarbon contaminant in the mixture, while increasing the concentration of carbon dioxide.

The mixture comprising carbon dioxide and contaminants from an underground formation can originate from nauturally occurring underground carbon dioxide or from oil formations which are undergoing enhanced oil recovery by carbon dioxide injection.

Energy or power can be produced as a by-production of the combustion. For example, heat can be recovered from hot off-gas for power generation or the combustion can take place in an engine used for gas compression.

Naturally occurring underground carbon dioxide is commonly found in conjunction with methane and other hydrocarbons and contaminants. Commonly, the underground stream comprises about 10 to about 95 mol percent carbon dioxide, the remainder comprising methane, $C_2$+ hydrocarbons, hydrogen sulfide, or mixtures thereof.

These carbon dioxide streams are recovered through underground wells by well-known techniques, and generally compressed and transported to the desired location by pipeline.

In order to minimize the cost of the purified carbon dioxide stream it is desirable to use feed mixtures for the combustion process which comprise less than about 50, preferably less than about 25, mol percent oxygen combustible material. In some cases where the feed mixture contains significant amounts of $C_2$ plus or hydrogen sulfide, it may be desirable to substantially separate these materials from the mixture by compression and cooling or scrubbing prior to combustion of the feed mixture.

Oxygen enriched gas is passed into the combustion zone to support combustion, and can be conveniently provided by the cryogenic separation of air. The oxygen enriched gas comprises at least about 90 mol percent, preferably at least about 95 mol percent, and more preferably at least about 98 mol percent, oxygen. Use of oxygen enriched gas for combustion instead of air allows the burning of feed streams having too little combustibles for conventional combustion. For example, nitrogen dilution from air may lower the already low methane content of the feed to an undesirably low level, while oxygen enriched gas may not.

Feed oxygen purity is generally dictated by the desired level of purity in the carbon dioxide product. It is generally desirable for the final carbon dioxide product to contain less than about 5 mol percent noncondensable gas contaminants such as nitrogen, oxides of notrigen, oxygen, methane, and carbon monoxide. Sulfur dioxide is not considered an undesirable contaminant in the product stream when such stream is used for enhanced oil recovery.

A portion of the combustion gases from the combustion zone may be recycled back to the combustion zone to reduce the oxygen concentration to control temperature and achieve proper combustion.

In the event the feed to the combustion zone contains very little oxygen combustible material such as methane and hydrogen sulfide, it is desirable to preheat at least a portion of the feed gases, the oxygen enriched gas and/or the mixture comprising carbon dioxide and contaminants, in order to achieve proper combustion. When the feed is low in combustible material, recycle of off-gas to the burner is not necessary. When the feed contains relatively high amounts of combustible material, off-gas recycle to the burner may be desirable to control burner temperature. Because carbon dioxide streams recovered from enhanced oil recovery floods contain widely varying concentrations of combustibles, it is preferred to detect combustibles in the feed to the burner by well-known means, and control off-gas recycle accordingly. The combustion zone is operated at combustion conditions which vary depending upon feed rate, combustion zone design and materials, and other factors. Commonly, combustion zone temperatures will range from about 1,500° C. to about 1,900° C., and pressures will range from about 20 to about 40 inches of water. Generally at least about 99 mol percent of the combustible organic matter in the feed is combusted.

Hot combustion gases from the combustion zone are passed to a heat recovery zone to recover energy. This is most commonly carried out in an industrial boiler where hot combustion gases transfer heat to fluids such as water for power generation. The boiler is preferably designed and operated to minimize air leakage into the combustion gas stream, thereby reducing nitrogen and oxygen contamination of the carbon dioxide product. This can be achieved by tight boiler shell design maintaining combustion gases within the boiler at pressures slightly in excess of the ambient air. It is also desirable to provide carbon dioxide gas detection means to protect nearby workers from possible leakage of combustion gases into work areas.

Conventional burners are used and suitable boilers can be provided by manufacturers. Existing boilers can be modified for use. Recycled process gas can be used as a sealing/cooling medium for soot blower openings, observation doors and precipitator. Seasls and values should be provided on soot blower penetrations through boiler walls.

Oxygen enriched gas is passed into the combustion zone at such a rate so that less than a 10 percent stoichiometric excess of oxygen is present for the combustion of the oxygen combustible contaminants. Preferably less than a 5 percent stoichiometric excess of oxygen is present for the combustion of the contaminants.

It is desirable to produce an enriched carbon dioxide stream comprising at least about 90, preferably at least about 95, mol percent carbon dioxide. It is also desirable for the purposes of enhanced oil recovery to provide a carbon dioxide stream for injection into the underground formation comprising less than about 5 mol percent total of nitrogen, oxygen, oxides of nitrogen, carbon monoxide and methane.

Prior to pipeline transport it is necessary to treat the off-gas from the combustion zone to substantially reduce the concentration of water and possibly oxides of sulfur concentration. Water concentration should be reduced to less than about 6 pounds per million SCF of gas in order to reduce corrosion. This can be accomplished by conventional methods such as compression and cooling, ethylene glycol absorption, and the like. Oxides of sulfur are not considered detrimental to the miscible oil recovery process, however in some cases they may accelerate corrosion in the transport and injection equipment. The concentration of these acidic materials can be substantially reduced by scribbing the gas stream with water/lime slurries. The corrosion problem can be substantially reduced by use of epoxy lined pipelines and injection tubing.

THE DRAWING

The drawing is a schematic diagram of a process showing one of the embodiments of this invention.

Air 1 is passed through line 2 to cryogenic separation zone 3 wherein the air is separated into its two main components, an oxygen enriched (or nitrogen deficient) stream and a nitrogen enriched stream. Such separation apparatus are commercially available, for example, from Air Products. The oxygen enriched stream comprising at least about 98 mol percent oxygen is passed through line 4 through preheater 5 where the oxygen enriched stream is preheated for combustion to about 600° F. and then through lines 6 and 9 to burner 10. It may be desirable in some cases to dilute the oxygenenriched stream with flue gases from line 63 to minimize the fire hazard presented by the possible leak of oxygen in the preheater. However, gases are generally recycled through line 80 to line 6.

Underground formation 7 produces a mixture of carbon dioxide, methane, light hydrocarbons such as ethane, ethene, propane, propene, and to a lesser degree higher boiling hydrocarbons, and hydrogen sulfide. This mixture can optionally be passed to compression and knock-out drum (not shown) so as to remove easily removable liquids and higher boiling gases. The gaseous mixture of carbon dioxide and oxygen combustible contaminants is passed through line 9 to burner 10. Oxygen from line 6 and oxygen combustible contaminants from line 9 react in burner 10 at oxidation conditions so as to substantially oxidize the contaminants. Gas analysis can be provided at position 65 to control oxidation conditions such as oxygen enriched gas and/or feed gas preheat, and/or flue gas recycle rate. The amount of oxygen from line 6 and/or the amount of gas flow from line 9 are controlled so as to maintain the stoichiometry of oxygen to combustible materials closely so that the off-gases emanating from burner 10 through line 11 contain very little oxygen or unburned contaminants. A slipstream is taken from line 11 through line 12 to gas analyzer 13 so that the proper stoichiometry can be maintained in combustion zone 10. In order to ensure complete oxidation of combustible contaminants and also complete removal of oxygen, a catalytic zone 14 can be provided to complete oxidation. Reducing gas such as methane 61 can be added to essentially fully react with oxygen present. This oxidation zone 14 can contain oxidation catalysts such as vanadium or platinum catalysts. One such catalyst comprises a platinum reforming type catalyst without the chloride, such as about 0.5 wt.% platinum on high surface area alumina. The hot combustion off-gases can be passed through line 15 to a boiler 16 for power generation or through line 18 to provide process heat 19 for various processes. The boiler should be constructed to minimize ingress of air, thereby preventing further contamination of off-gases with oxygen and nitrogen. The gases can be passed through lines 17 and/or 20 to heat exchanger 5 for the preheating of oxygen enriched gas as feed to burner 10. Gases from preheater 5 are passed through line 21 to a scrubber zone which can substantially cool the gases and if desirable also remove oxides of sulfur. Either water or a water/lime slurry 24 can be passed through line 23 for contact with gases in the scrubber 22. Water will cool the gases and also remove a small amount of the oxides of sulfur. However, a lime slurry is preferable if it is desired to remove a substantial amount of the oxides of sulfur. Spent water or slurry from the scrubber 22 can be removed through line 40 for recycle, regeneration or disposal 41. A portion of the gases from line 21 can be recycled to line 6 to control burner temperature. Gases from scrubber 22 are passed through line 25 for compression and separation of water. It is preferable to use multistage compressors 26 with interstage cooling and water separation. Water is removed from the compressor through line 82. Gas from compressor 26 is passed to a molecular sieve drier or an ethylene glycol water removal means 46. Because water can cause corrosion in various equipment, it is desirable to remove water to a level less than 6 pounds per million SCF. In water removal means 46, ethylene glycol 47 is passed through line 48 for contact with gases from line 81. Spent ethylene glycol plus water are removed through line 50 for regeneration and recycle or disposal 51.

Purified carbon dioxide stream from line 49 is passed through line 92 for introduction into well 56 in underground petroleum formation 55. Carbon dioxide, sometimes in conjunction with water 93 is injected into well 56 at the desired pressure in order to achieve the desired pore volume of solvent carbon dioxide or carbon dioxide/water. Carbon dioxide injection can be followed by injection of chase gas such as nitrogen or nitrogen/water. The nitrogen can conveniently be provided from air separation zone 3 through lines 54 and 92.

I claim:

1. A method for the enhanced recovery of liquid hydrocarbons from underground formations comprising:

recovering a mixture comprising carbon dioxide and about 5 to about 90 mol percent contaminants comprising hydrocarbon, hydrogen sulfide, or mixtures thereof, from an underground formation;

combusting said mixture with an oxygen enriched gas to form a concentrated carbon dioxide stream containing less than about 10 mol percent nitrogen, oxygen, oxides of nitrogen, hydrocarbon, hydrogen sulfide, carbon monoxide, or mixtures thereof; and injecting at least a portion of said concentrated carbon dioxide stream into an underground formation to enhance recovery of liquid hydrocarbon.

2. The method of claim 1 wherein the concentrated carbon dioxide stream comprises at least about 90 mol percent carbon dioxide.

3. The method of claim 2 wherein the concentrated carbon dioxide stream comprises at least about 95 mol percent carbon dioxide.

4. The method of claim 3 wherein the concentrated carbon dioxide stream comprises at least about 98 mol percent carbon dioxide.

5. The method of claim 1 wherein the oxygen enriched gas comprises less than a 10 percent stoichiometric excess of oxygen for the combustion with oxygen of combustible contaminants.

6. The method of claim 5 wherein the oxygen enriched gas comprises less than a 5 percent stoichiometric excess of oxygen for the combustion with oxygen of combustible contaminants.

7. The method of claim 1 wherein the oxygen enriched gas comprises at least about 90 mol percent oxygen.

8. The method of claim 7 wherein the oxygen enriched gas comprises at least about 95 mol percent oxygen.

9. The method of claim 8 wherein the oxygen enriched gas comprises at least about 98 mol percent oxygen.

10. The method of claim 1 wherein the hydrocarbon comprises methane.

11. A method for the enhanced recovery of liquid hydrocarbons from underground formations comprising:

recovering a mixture comprising carbon dioxide and about 5 to about 90 mol percent contaminants comprising hydrocarbon, hydrogen sulfide, or mixtures thereof, from an underground formation;

comusting said mixture with an oxygen enriched gas to form a concentrated carbon dioxide stream containing less than about 10 mol percent nitrogen, oxygen, oxides of nitrogen, hydrocarbon, hydrogen sulfide, carbon monoxide, or mixtures thereof; and first injecting a stream comprising at least a portion of the carbon dioxide stream into an underground formation and then injecting a stream comprising at least a portion of a nitrogen enriched stream into the underground formation to effectively move the injected carbon dioxide within the formation and enhance recovery of liquid hydrocarbon.

12. A method for the enhanced recovery of liquid hydrocarbons from underground formations comprising:

recovering a mixture comprising carbon dioxide and about 5 to about 90 mol percent contaminants comprising hydrocarbon, hydrogen sulfide, or mixtures thereof, from an underground formation;

combusting said mixture with an oxygen enriched gas to form a concentrated carbon dioxide stream containing less than about 10 mol percent nitrogen, oxygen, oxides of nitrogen, hydrocarbon, hydrogen sulfide, carbon monoxide, or mixtures thereof;

recovering heat or energy from the combustion of the mixture; and injecting at least a portion of said concentrated carbon dioxide stream into an underground formation to enhance recovery of liquid hydrocarbon.

* * * * *

UNITED STATES PATENT OFFICE
CERTIFICATE OF CORRECTION

PATENT NO. : 4,344,486
DATED : August 17, 1982
INVENTOR(S) : David R. Parrish

It is certified that error appears in the above-identified patent and that said Letters Patent are hereby corrected as shown below:

Column 3, line 68, "Seasls" should read --Seals--.

Column 4, line 29, "scribbing" should read --scrubbing--.

Column 6, line 39, "comusting" should read --combusting--.

Signed and Sealed this

Ninth Day of August 1983

[SEAL]

*Attest:*

GERALD J. MOSSINGHOFF

*Attesting Officer* *Commissioner of Patents and Trademarks*